US005699661A

United States Patent [19]

Maruki

[11] Patent Number: 5,699,661

[45] Date of Patent: Dec. 23, 1997

[54] SPINNING APPARATUS AND METHOD FOR PRODUCING A FALSE TWISTED SPURN YARN

[75] Inventor: Hiroshige Maruki, Kusatsu, Japan

[73] Assignee: Murata Kikai Kabushiki Kaisha, Kyoto, Japan

[21] Appl. No.: 502,319

[22] Filed: Jul. 13, 1995

[30] Foreign Application Priority Data

Jul. 15, 1994 [JP] Japan ..... 6-186780

[51] Int. Cl.[6] ..... D01H 5/00; D01H 5/28

[52] U.S. Cl. ..... 57/328; 57/5; 57/315; 57/318; 57/331; 57/332; 57/333; 57/334; 57/335

[58] Field of Search ..... 57/315, 318, 328, 57/330, 331, 332, 333, 334, 335, 336, 284, 350, 5, 337, 351; 242/157 R, 149, 150 R, 151; 792/27, 59; 226/190

[56] References Cited

U.S. PATENT DOCUMENTS

| | | | |
|---|---|---|---|
| 331,328 | 12/1885 | Randall | 492/27 |
| 2,943,433 | 7/1960 | Van Dijk | 57/335 |
| 3,842,582 | 10/1974 | Ritcher | 57/336 |
| 4,047,373 | 9/1977 | Takai | 57/77.4 |
| 4,400,931 | 8/1983 | Maeda | 57/336 |
| 4,442,663 | 4/1984 | Shindo | 57/336 |
| 4,519,203 | 5/1985 | Schippers | 57/331 |
| 4,583,355 | 4/1986 | Vignon | 57/328 |
| 4,823,545 | 4/1989 | Flueckiger | 57/328 |
| 5,094,068 | 3/1992 | Hirao | 57/338 |
| 5,228,281 | 7/1993 | Stahlecker | 57/328 |
| 5,243,813 | 9/1993 | Stahlecker | 57/315 |
| 5,551,225 | 9/1996 | Maruki et al. | 57/328 |

FOREIGN PATENT DOCUMENTS

| | | | |
|---|---|---|---|
| 2667618 | 4/1992 | France | 57/328 |
| 4-5302220 | 11/1993 | Japan | 57/328 |
| 6-123016 | 5/1994 | Japan | 57/336 |
| 6-123017 | 5/1994 | Japan | 57/336 |
| 6-123018 | 5/1994 | Japan | 57/328 |

*Primary Examiner*—William Stryjewski

*Attorney, Agent, or Firm*—Armstrong, Westerman, Hattori, McLeland & Naughton

[57] ABSTRACT

This invention is concerned with a spinning apparatus with an arrangement of a spinning nozzle which generates a rotating air current positioned close to the front roller and a pair of false twist units having hollow cylindrical rollers formed from elastic material which are positioned down stream from that spinning nozzle. As contact surfaces are formed that nip the fiber bundle by contacting the hollow cylindrical rollers having elastic properties, the fiber bundle can be reliably nipped in conjunction with the elasticity and the centrifugal force of the hollow cylindrical rollers. Even when driving the false twist apparatus at high speed a sufficient false twist can be imparted, a strong delivery power and unwinding power can be applied to the fiber bundle, and not only can high speed spinning be achieved, but also a strong, uniform spun yarn with little hairiness can be manufactured.

2 Claims, 5 Drawing Sheets

SPINNING APPARATUS AND METHOD FOR PRODUCING A FALSE TWISTED SPURN YARN

BACKGROUND OF THE INVENTION

1. Field of the Invention

This invention is concerned with a spinning apparatus which produces a spun yarn by having a twist imparted by a false twist apparatus after a sliver has been drafted by a draft apparatus.

2. Prior Art

Previously, a spinning apparatus which after a sliver was drafted by a draft apparatus, a twist was imparted on the sliver-by a pair of spinning nozzles where opposite rotating air currents are supplied to each other and spun yarn is produced, or a spinning apparatus that used a belt type false twist apparatus in place of one spinning nozzle of the above spinning nozzles was known.

Previous spinning apparatus possessed a spinning nozzle (known here after as simply the "first nozzle") positioned on the front roller side of the draft apparatus and a spinning nozzle (known here after as simply the "second nozzle") positioned down stream from the first nozzle or a belt type false twist apparatus. A twist reaching to the nip point of the front roller was imparted on the fiber boundle which was guided to the belt type false twist apparatus or the second nozzle after passing the first nozzle from the front roller of the draft apparatus by the second nozzle or belt type false twist apparatus. Conversely, between the front roller and the first nozzle, the fiber bundle is ballooned in the opposite direction to the above false twist direction. Due to this ballooning, the end of the fibers forming the surface part of the fiber bundle takes on a free appearance. Furthermore, the free end fibers formed by the circumference of the fiber bundle pass through the belt type false twist apparatus or second nozzle in order to impart a false twist and in a process where the twist is untwisted, they are wound around the core fibers which has been untwisted in the opposite direction to the inserted twist and thus forming spun yarn having the core fibers and the winding fibers.

In the spinning apparatus using the belt type false twist apparatus described above, a strong uniform spinning fiber can be manufactured by many strong false twists being imparted in the fiber bundle reaching from that false twist apparatus to the front roller point due to the false twist apparatus positioned down stream from the first nozzle and high speed spinning is possible. Also, at the false twist apparatus positioned down stream from the first nozzle, as the fiber bundle is gripped tightly, a stronger delivery power is applied to the yarn, the yarn runs more quickly and spinning can take place at a higher speed. Furthermore, on the false twist apparatus positioned down stream from the first nozzle, as the fiber bundle is gripped strongly, a strong unwinding power can be applied to the fiber bundle and due to this, a strong and uniform spinning fiber can be produced.

However, when a spinning nozzle is used as a false twist apparatus positioned down stream as mentioned above, because there can be no gripping due to the mechanical direct contact, many strong false twists are unable to be imparted in the fiber bundle and Consequently, a strong uniform spun yarn is not manufactured and high speed spinning is unattainable. Also, the fiber bundle can not be gripped strongly so the delivery power applied to the yarn is weak and a strong untwisting power can not be applied. Consequently, not only can the yarn not run at high speeds and high speed spinning not occur but also there is the problem that a strong uniform spun yarn can not be manufactured.

When a belt type false twist apparatus is used as a false twist apparatus positioned downstream from the first nozzle, because the belts loosen and the fiber bundle is not reliably gripped between the belts, the above problems arise. Also, on a belt type false twist apparatus, change of twist of a yarn, due to elongation and function of the belts easily occur and as a consequence, a strong uniform spun yarn can not be manufactured.

SUMMARY OF THE INVENTION

An object of the present invention is to solve the problems existing in the aforementioned previous spinning apparatus and to propose a spinning apparatus capable of manufacturing spun yarn with uniformity and strength and at a higher speed.

In order to achieve the aforementioned object, this invention comprises a spinning nozzle which generates a rotating air current positioned near front rollers and a pair of false twist units having a hollow cylindrical roller formed from soft elastic material positioned down stream from the nozzle in the spinning apparatus. Also, the central part of the above hollow cylindrical roller is expanded to form a barrel shape and furthermore, there are holes bored in the aforementioned hollow cylindrical roller.

DETAILED DESCRIPTION OF THE PREFERRED EMBODIMENT

Figure 1:
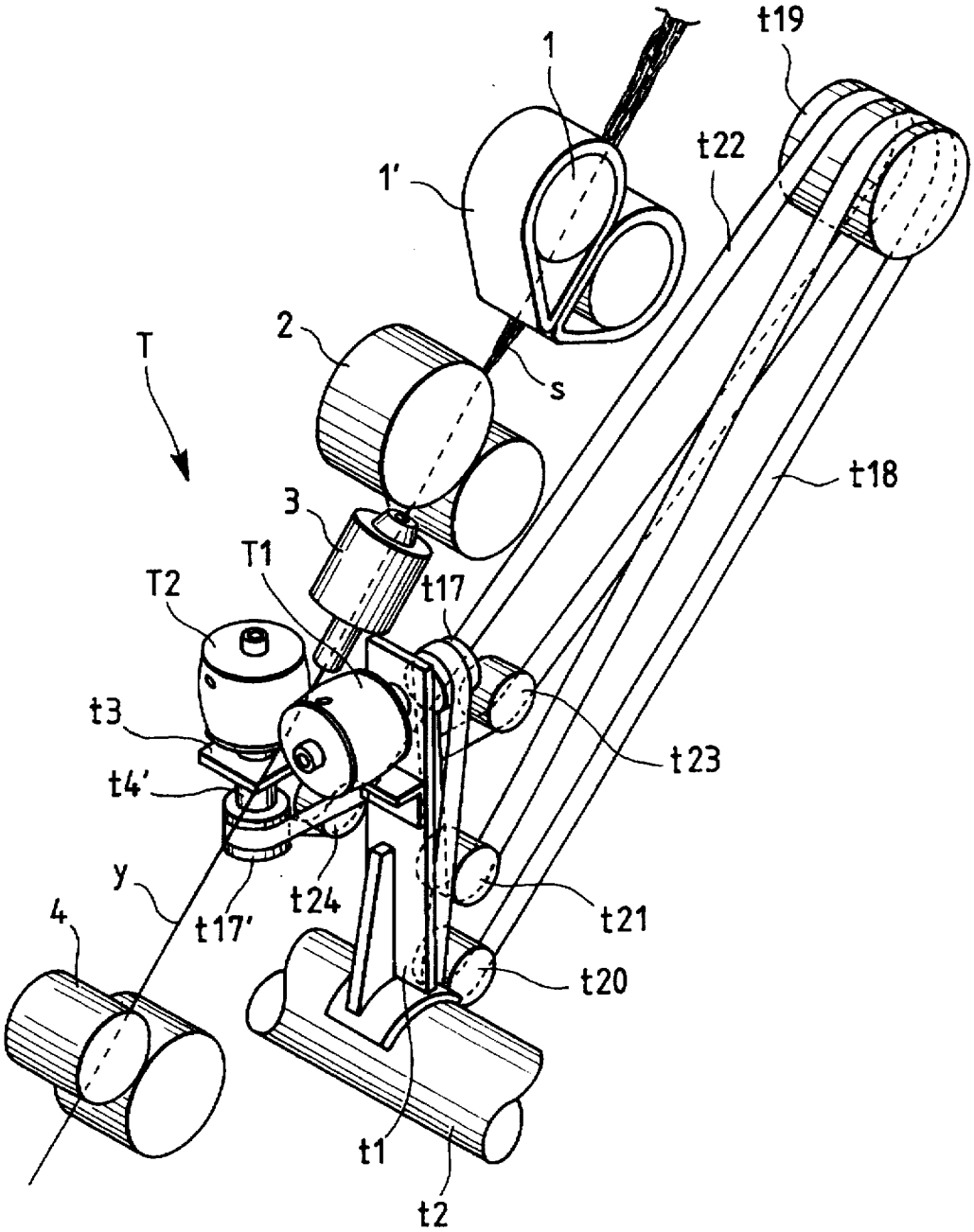
FIG. 1 is a summarized perspective view of the spinning apparatus of a first embodiment of this invention.

A first embodiment of the present invention will be explained hereinafter using FIG. 1 which is a summarized perspective view of the spinning apparatus of this invention and FIG. 2 which is a sectional view in the direction of an axis of the false twist unit which comprises the false twist apparatus used in the spinning apparatus of this invention. If the purposes of the present invention are not exceeded, the present invention is not limited to these embodiments.

(1) and (2) are respectively a middle roller and front roller having an apron 1' forming a draft apparatus. (3) is a known spinning nozzle for generation of a rotating air current positioned downstream of the front roller (2). T is a false twist apparatus comprising a pair of false twist units T1, T2 having rotating shafts which cross each other and which are positioned down stream from the spinning nozzle (3). The details of this false twist apparatus will be explained hereafter. (4) is a delivery roller formed from a pair of rollers for taking out the manufactured spun yarn y. A fiber bundle s sent from the front roller (2) from the spun yarn y by the spinning nozzle (3) and the false twist apparatus T. After the spun yarn y is taken out by the delivery roller (4) it is wound onto a bobbin of a take-up apparatus (not shown).

Next, the false twist apparatus T consisting the pair of false twist units T1, T2 which are positioned down stream from the spinning nozzle 3 will be explained.

t1 is a vertical frame attached to a suitable fixed shaft t2 of the spinning apparatus. A false twist units T1 of the false twist apparatus T is positioned on the upper part of the vertical frame t1. t3 is a horizontal frame attached to roughly the middle part of the vertical frame t1. The other false twist unit T2 of the false twist apparatus T is positioned on the end of the horizontal frame t3.

Next, using mainly FIG. 2, the false twist units T1, T2 etc will be explained. The structure and attachment means of false twist units T1 and T2 are the same so the false twist unit T1 attached to the vertical frame t1 will be explained. The parts of false twist unit T2 corresponding to those of T1 are designated by a numeral or a symbol having a dash ' attached.

t4 is a rotating shaft running through bearings t5 which are supported by the boss t6 which is attached to the vertical frame t1. t7 is a maintenance member positioning a flat brim part t8 and cylindrical brim part t9 at a predetermined spacing. The maintenance member t7 is attached to the rotating shaft t4 by a suitable fixing means in such a way that the flat brim part t8 is positioned on the end side part of the rotating shaft t4 and one part of the boss t6 is positioned at a predetermined spacing within the cylindrical brim part t9. Also, a open part t10 protrudes from the circumference outer side of the open end positioned on the vertical frame side t1 of the cylindrical brim part t9.

t11 is a barrel shaped hollow cylindrical roller with an expanded central part having a suitable softness and elasticity formed from elastic material, for example rubber or synthetic resin. The hollow cylindrical roller t11 is formed in such a way that it's diameter decreases from the central part toward both of the end parts and that it is connected to the maintenance member t7 by one end t12 of the hollow cylindrical roller t11 attached to the outer circumference of the flat brim part t8 of the maintenance member t7 and the other end t13 of the hollow cylindrical roller t11 being attached to the cylindrical brim part t9 of the maintenance member t7. In this way, one end t13 of the hollow cylindrical roller t11 which is connected to the maintenance member t7 is in contact with open part t10 which protrudes from cylindrical brim part t9 of the maintenance member t7 such that the hollow cylindrical roller t11 can not pass over the open part t10 and move towards the vertical frame t1. Also, the other end t12 of the hollow cylindrical roller t11 connected to maintenance member t7 is connected to a flange t15 having a slightly larger outer diameter than the inner diameter of the end t12 of the hollow cylindrical roller t11 and which is attached to the end of the rotating shaft t4 by an appropriate fixing means for example the bolt t14. Consequently, the hollow cylindrical roller t11 is so formed that it can not pass over the flange t15 and move towards the end of the rotating shaft t4. As described above, as each of the ends t12, t13 of the hollow cylindrical roller t11 which is inserted onto the cylindrical brim part t9 and the flat brim part t8 of the maintenance member t7 is formed so that it is in contact with both the open part t10 protruding from the cylindrical brim part t9 and the flange t15 attached to the end of the rotating shaft t4, any movement along the longitudinal axis of the rotating shaft t4 is prevented and it rotates stabily with no vibration.

When the false twist units T1, T2 which have become hot by operating are to be stopped, if temperature of the air in the hot false twist units T1, T2 is higher than the temperature of the air outside, structural changes or shrinkage of the hollow cylindrical roller t11 may occur. In order to prevent this kind of structural change or shrinkage of the hollow cylindrical roller t11, a suitable number of holes t16 are bored into the hollow cylindrical roller t11. When the fiber bundle s is gripped and imparted a twist by the hollow cylindrical rollers t11 of the false twist units T1, T2, the fiber bundle s becomes positioned in the central area of the hollow cylindrical roller t11 and therefore it is preferable for the aforementioned holes t16 to be bored in the end portion of the hollow cylindrical roller t11 so that the fiber bundle s does not touch the holes t16.

t17 is a pulley attached to the end of the rotating shaft t4 on the opposite side to the side where the hollow cylindrical roller t11 is positioned. It is so formed that the rotating shaft t4 is rotated by the pulley t17 driven by a belt t18 (described later) and thus the hollow cylindrical roller t11 inserted onto the maintenance member t7 is rotated.

Figure 2:
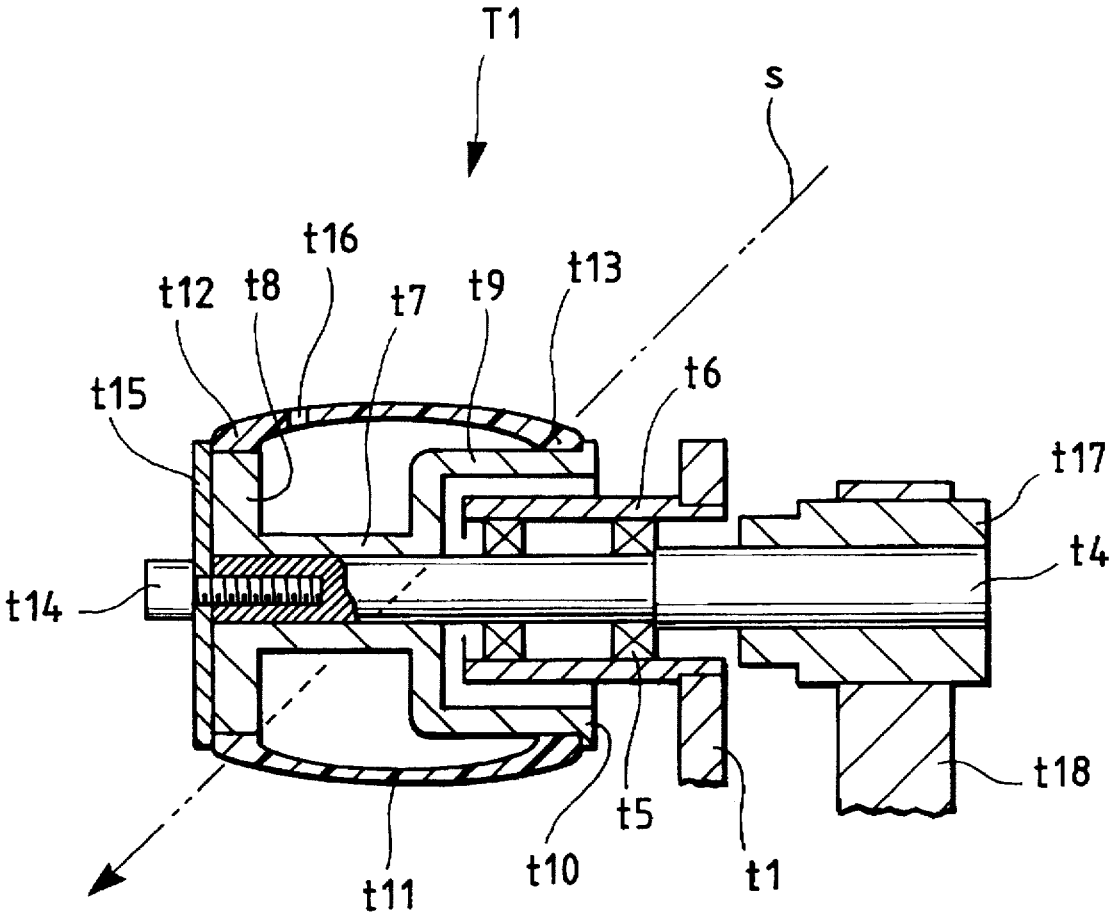
FIG. 2 is a sectional view in the direction of an axis of the false twist unit which comprises the false twist apparatus used in the spinning apparatus of the first embodiment of this invention.

In FIG. 1, t19 is a drive shaft driven by a suitable drive source of the spinning apparatus. This drive shaft t19 is so formed that the false twist unit T1 are driven by belts t18 stretched onto the drive shaft t19 which are guided through guide pulleys t20, t21 placed in appropriate positions and are caught on the pulley t17 attached to the rotating shaft t4. The other false twist unit T2 is driven in the same way by belts t22 stretched onto the drive shaft t19 being guided over guide pulleys t23, t24 placed in appropriate positions and catching on pulley t17' attached to the rotating shaft t4'.

As shown in FIG. 1, one false twist unit T1 of the false twist units T1, T2 having the structure described above is positioned so that the rotating shaft t4 is roughly horizontal. The other false twist unit T2 is positioned so that the rotating shaft t4' is roughly vertical. Furthermore, the false twist units T1, T2 are positioned so both of the hollow cylindrical rollers t11 make surface contact and due to the contact between the hollow cylindrical rollers t11, the fiber bundle s is held and a twist is imparted in the fiber bundle s as the bundle fiber yarn passes between the rollers.

As described above, because not only is the hollow cylindrical roller t11 comprised of a soft elastic material, but also, the central part is expanded to form a barrel shape, by the central expanded part of the pair of hollow cylindrical rollers t11 being in contact, and by controlling the proximity and separation of the pair of hollow cylindrical rollers t11 in this state, the contact surface area and contact pressure etc can be controlled. The contact pressure and contact surface area etc of the hollow cylindrical roller t11 are set so the contact surface does not form a curved surface when the hollow cylindrical rollers t11 are contacted while considering the fiber length of the fiber bundle s, the fibers forming the fiber bundle s and the rotational speed of the false twist units T1, T2 etc. Also, the elasticity or softness of the hollow cylindrical roller t11 comprised of the elastic material is set in the same way, while considering the fiber length of the fiber bundle s, the fibers forming the fiber bundle s and the rotational speed of the false twist units T1, T2 etc.

For the aforementioned embodiments, the false twist units T1, T2 are driven by the belts t18, t22 but the rotating shafts t4, t4' can be driven directly by the motor etc. Also, one rotating shaft t4 can be driven by a motor etc while the other rotating shaft t4' can be rotated by a belt or by some suitable conveyance means for example a belt, a gear etc.

Next, while supressing the heat generation from the roller, a spinning apparatus is proposed that can carry out stable false twisting and can maintain the large area of the nip point.

For this, on the spinning apparatus that is formed from a pair of rotating bodies which intersect each other and are maintained in a contact position and nip the yarn by that contact part and feed the yarn, the pair of rotating bodies are formed from flexible and elastic material, moreover, they differ in their stiffness. Also, the aforementioned rotating bodies are hollow rollers and due to the circumference partdiffering in thickness the stiffness is different. Further, an air spinning nozzle which generates a rotating air current is positioned on the up stream yarn path side of the aforementioned rotating bodies.

On the aforementioned spinning apparatus, the elastic deformation of the pair of rotating bodies in the contact position mainly occurs on the softer side of the rotating bodies. Moreover, this deformation pattern is uniform and there is no excessive adhesion of the contact surface and as the pressure distribution on the contact surface is weak, the heat generation by the elastic deformation and friction between the pair of rotating bodies becomes smaller. Due to this, the amount of pressing against the pair of rotating bodies is greater and the contact surface, in short, the yarn nip point, is maintained as a large area and stable false twisting can occur. Furthermore, yarn deviation and yarn breakage due to this is reduced and when yarn joining, the introduction of the yarn between the rotating bodies is easy.

Also, on the aforementioned spinning apparatus, hairiness of the yarn is suppressed by nipping the yarn with the pair of rotating bodies and false twisting. Furthermore, sufficient false twist power and feed power can be obtained and high speed spinning with a strong uniform yarn can be carried out.

A second embodiment will be explained with reference to FIGS. 3 and 4.

Figure 3:
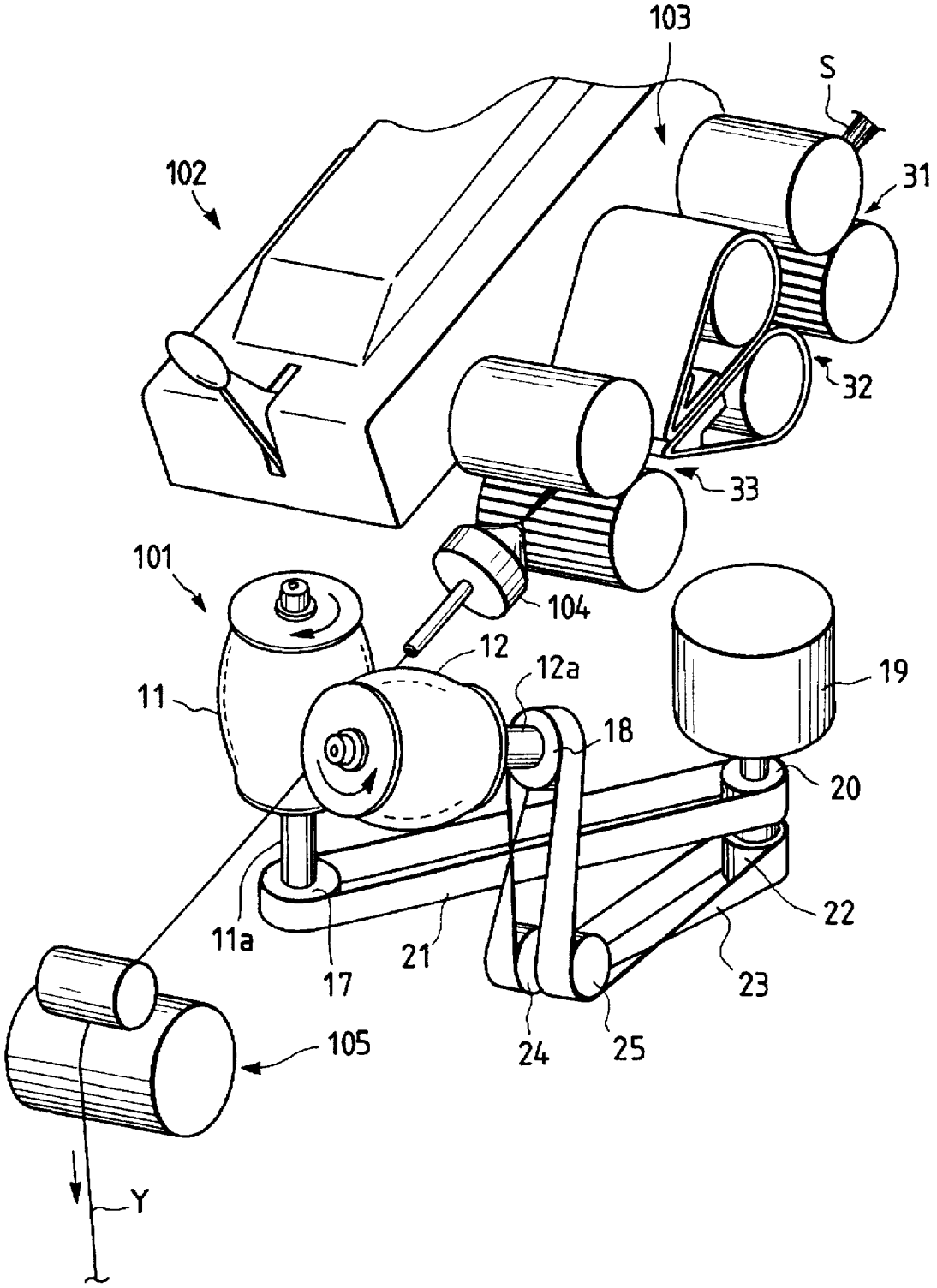
FIG. 3 shows a perspective view of the spinning apparatus provided with the false twist apparatus of the second embodiment of this invention.
Figure 4:
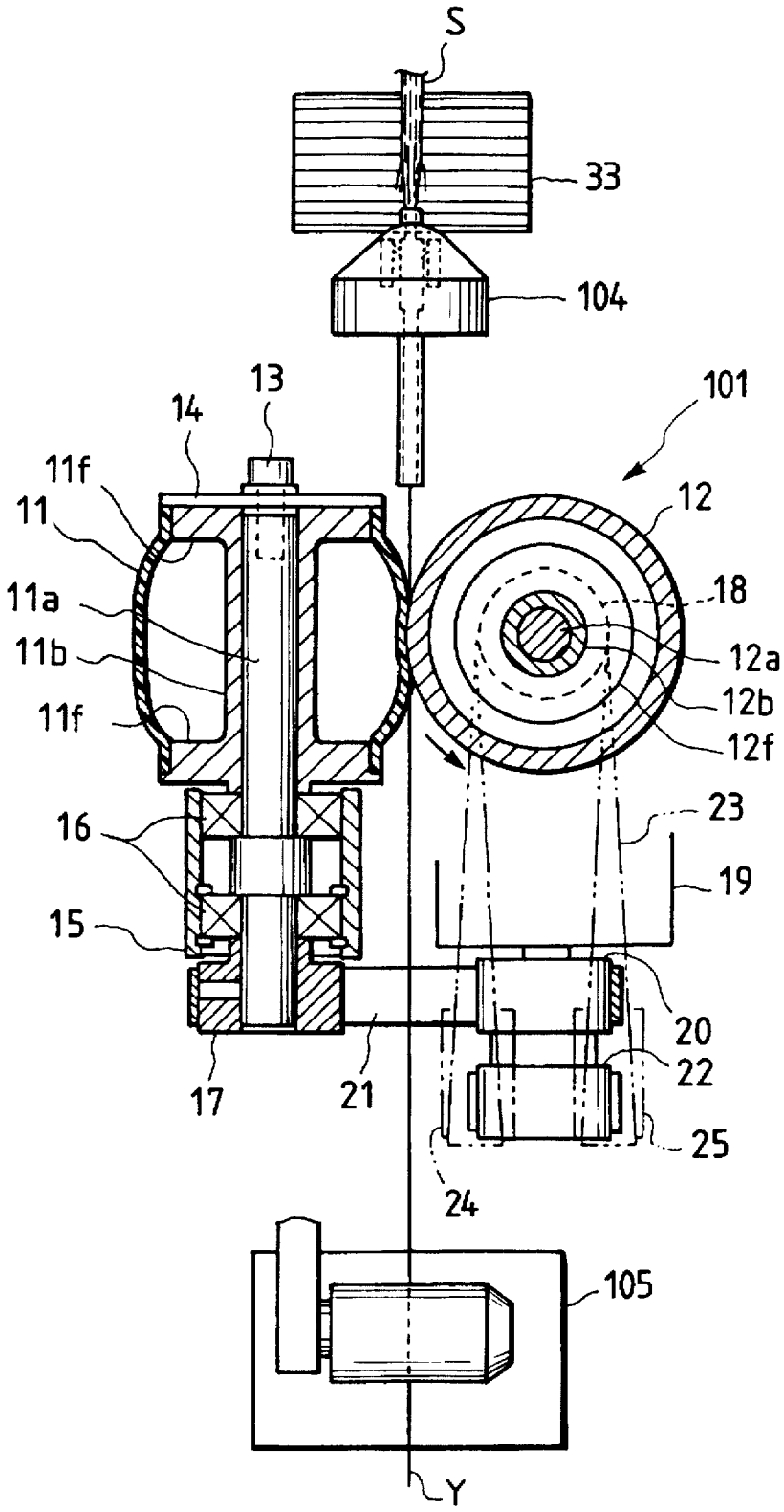
FIG. 4 is a front view partly in section showing the spinning apparatus provided with the false twist apparatus of the second embodiment of this invention.

FIGS. 3 and 4 show a spinning apparatus 102 having a false twist apparatus 101 of a second embodiment of this invention. In the figures, the spinning apparatus 102 is comprised of an air spinning nozzle 104 and a false twist apparatus 101 being positioned in a line down stream from a front roller 33 of a draft apparatus 103 which is composed of a back roller 31, a middle roller 32 and the front roller 33. And the apparatus 102 is comprised of the delivery roller 105 and winding apparatus (not shown) etc being positioned down stream from the false twist apparatus 101.

The false twist apparatus 101 is comprised of a pair of hollow balloon rollers 11, 12 which are supported in a contact position and which intersect with each other in their rotational directions. The hollow rollers 11, 12 are both hollow inside and thin and are formed from a flexible and elastic material, for example rubber, synthetic resin etc. The circumference wall part of the hollow rollers 11, 12 is thin. Moreover, the middle part is expanded to form a barrel shape as compared to both ends. Also, after both of the ends of the hollow rollers 11, 12 are connected to both of flange parts 11*f*, 12*f* of the roller core 11*b*, 12*b* fixed onto the roller rotating shaft 11*a*, 12*a*, a round plate 14 is fixed on to the end of each rotating roller shaft 11*a*, 12*a* by a screw 13. Due to this, in this situation where any movement of the hollow roller 11, 12 from the roller core 11*b*, 12*b* in a longitudinal direction is regulated, the hollow roller 11, 12 is supported on only either end by the roller core 11*b*, 12*b* and is hollow in the roller's center part.

Each of the aforementioned hollow rollers 11, 12 are basically constructed in the same way and only the thickness of the circumference wall part of the hollow roller differs. One of the hollow rollers 12 is thicker than the other hollow roller 11 and due to this, each hollow roller 11, 12 differs in their relative stiffness.

Furthermore, as shown, concerning only one of the rotating shaft 11*a* in FIG. 4, the rotating shaft 11*a*, 12*a* of each hollow roller 11, 12 rotates freely supported by a bracket 15 fixed to a frame not shown via bearings 16. Also, pulleys 17, 18 are fixed to the other end of each of the rotating shaft 11*a*, 12*a*. Among these, a belt 21 is attached between the one of the pulleys 17 and the pulley 20 fixed to the rotating shaft of the motor 19. A belt 23 is wound around idle pulleys 24, 25, the pulley 18 and the pulley 22 connected to the aforementioned pulley 20. Due to this, when the aforementioned motor 19 drives, that rotation is transmitted to each of the rotating shafts 11*a*, 12*a* via the belts 21, 23 and the hollow rollers 11, 12 are made to rotate simultaneously at the same rotational speed.

The aforementioned hollow roller 11, 12 is positioned so that the yarn pathway between the air spinning nozzle 104 and the delivery roller 105 is positioned on a bisector of a cross angle formed by the rotational directions of rollers 11, 12 on the contact part of rollers 11, 12. Moreover, the revolution speed of each hollow roller 11, 12 is set so that the yarn running direction component is the same as or slightly larger than the running speed of the yarn Y.

Next, the actions will be explained based on the above described embodiments.

The hollow rollers 11, 12 of the false twist apparatus 101 are pushed by a predetermined pressing amount from a contact position without any elastic deformation and are supported in a pressing state against each other. In this state, as shown in FIG. 4, the elastic deformation of the aforementioned pair of hollow rollers 11, 12 that differ greatly in thickness occurs more noticeably on the hollow roller 11 with the softer thinner side. This deformation pattern is uniform. And if this is compared to a case of contact between two rollers of equal thickness, the pressure distribution on the contact surface is weaker and the contact area is larger.

Due to this, in the above pressing state of the hollow rollers 11, 12 when they are rotating simultaneously by the aforementioned driving means, heat generation by the elastic deformation and friction between those hollow rollers 11, 12 can be kept to a minimum, a sufficient pressing amount of the hollow rollers 11, 12 can be taken and the contact surface area between the two rollers 11, 12 can be kept as large as possible.

Consequently, within the contact surface, the nip point of the yarn Y can be maintained as large as possible, the yarn Y can be reliable nipped and not only can a false twist be reliably imparted but also, any deviation of the yarn Y from the aforementioned contact surface and yarn breakage associated with the deviation is reduced. Also, introduction of the yarn Y between the hollow rollers 11, 12 can easily be carried out.

Furthermore, because the aforementioned false twist apparatus 101 mechanically nips the yarn Y by the pair of hollow rollers 11, 12 and a false twist is imparted, sufficient false twist and delivery power to the yarn can be obtained. Due to this, on the spinning apparatus 102 which has an air spinning nozzle 104 positioned upstream from the false twist apparatus 101, the yarn Y does not balloon between the false twist apparatus 101 and the front roller 33 of the draft apparatus 103 and vibrations by the ballon do not occur. Thus the false twist to the yarn Y by the false twist apparatus is reliably transmitted upstream. Also, the convergent point of the sliver fed out from the front roller 33 is stable and a strong and uniform yarn can be spun. Further, when the fiber bundle passing through the air spinning nozzle 104 is nipped by the pair of hollow rollers 11, 12 of the false twist apparatus and is false twisted, the hairiness on the yarn surface is twisted into the yarn itself and due to this, the obtained yarn Y is not hairy and has a perfect exterior.

Next, the effectiveness of this invention will be verified by concrete test data based on the aforementioned embodiment.

Table 1 shows data for a blended yarn of 65% polyester, 35% cotton, 30 yarn count obtained under spinning conditions of a spinning speed of 300 m/min by a spinning apparatus 102 as shown in FIGS. 3 and 4 with NBR rubber hollow rollers 11, 12 with a rubber thickness of 1.35 mm and 1.8 mm respectively and a pressing amount of 3 mm while changing the conditions of the hollow roller rotation speed and the air spinning nozzle pressure, and by a 2-nozzle type air spinning apparatus show as a conventional one.

TABLE 1

| | | This Inventions' Embodiments | | | | Previous example |
|---|---|---|---|---|---|---|
| Condition | Roller speed (rpm) | 2790 | 2740 | 2690 | 2510 | — |
| | Nozz' pres' ($kg/cm^2$) | 2.5 | 3.5 | 3.5 | 3.0 | 2.0–7.0 |
| Data | Yarn count (Ne) | 30.35 | 30.53 | 30.40 | 30.75 | 30.99 |
| | Single yarn strength | 360 gr | 379 gr | 378 gr | 390 gr | 367 gr |
| | Strength CV % | 6.7 | 6.0 | 6.9 | 7.8 | 9.5 |
| | RKH (g/Tex) | 18.60 | 19.55 | 19.44 | 20.29 | 19.24 |
| | Single elongation (%) | 19.29 | 10.36 | 10.75 | 10.27 | 7.85 |
| | Elongation CV % | 7.1 | 9.6 | 7.8 | 9.8 | 10.2 |
| | Uniformity % | 10.70 | 9.83 | 9.84 | 9.78 | 10.53 |
| | Thin (/Km) | 8 | 2 | 0 | 2 | 8 |
| | Thick (/Km) | 28 | 24 | 26 | 24 | 16 |
| | Nep (/Km) | 130 | 102 | 102 | 78 | 83 |
| | 0.5 mm hairiness quantity (/10 m) | 368 | 385 | 340 | 299 | 2752 |

As shown in Table 1, the data of a spun yarn obtained by the present embodiments, specifically the yarn strength, elongation and IPI value such as uniformity U %, Thin and Thick, are improved when compared to yarn spun by the conventional apparatus. Furthermore, there is ample scope remaining for increases in speed. Also, the hairiness quantity in Table 1 is the total quantity of hairiness observed in a position 0.5 mm separated from the center of the yarn for a 10 m length of spun yarn and the hairiness quantity of this invention's spun yarn has been reduced to a level roughly 1 tenth of the hairiness quantity of the previous spun yarn and this invention's spun yarn has practically no hairiness.

Under the same spinning conditions, an experiment was tried with both hollow rollers having the same thickness of 1.8 mm or 1.35 mm. For the former 1.8 mm if the pressing amount is set higher than 1.5 mm, heat generation increases, the yarn may come out from between the hollow rollers and continuous spinning is impossible. For the latter 1.35 mm, there is not a great deal of heat generation but the pressure between the hollow rollers becomes unstable and test data was unobtainable. Furthermore, in this case, it has been ascertained that it is difficult to insert the yarn between the hollow rollers when the yarn is, to be joined. Thus when the thickness of the hollow rollers is the same, it is difficult to set the roller thickness and pressing amount etc but for the described false twist apparatus 101 of the present inventions embodiments, the pressing amount range is large and setting is easy.

For the above described embodiments, the stiffness is different in the pair of rollers 11, 12 by there being a difference in thickness of the hollow rollers 11, 12 but a non-hollow roller can also be used as the thickner roller 12. Also, even if the pair of hollow rollers 11, 12 appear the same thickness on outward appearance in their natural state, by using materials of different elasticities for each of the hollow rollers 11, 12, the same effectiveness can be obtained.

Furthermore, on the aforementioned embodiment, each of the pair of rotating bodies is a hollow roller but both can be continuous belts or one of the pair can be a hollow roller and the other can be a continuous belt or this invention can also use the false twist process of a filament yarn.

Also, the angle θ forming the yarn delivery component force of the pair of rotating bodies, in short, the angle formed between the yarn delivery component force of the roller 11 and the yarn delivery component force of the roller 12 should be within the range 70°~85° and preferably within the 75°~80° range. Below 70°, twisting becomes difficult, and above 85° there is too much twisting, yarn breakage increases and yarn strength is reduced.

Figure 5:
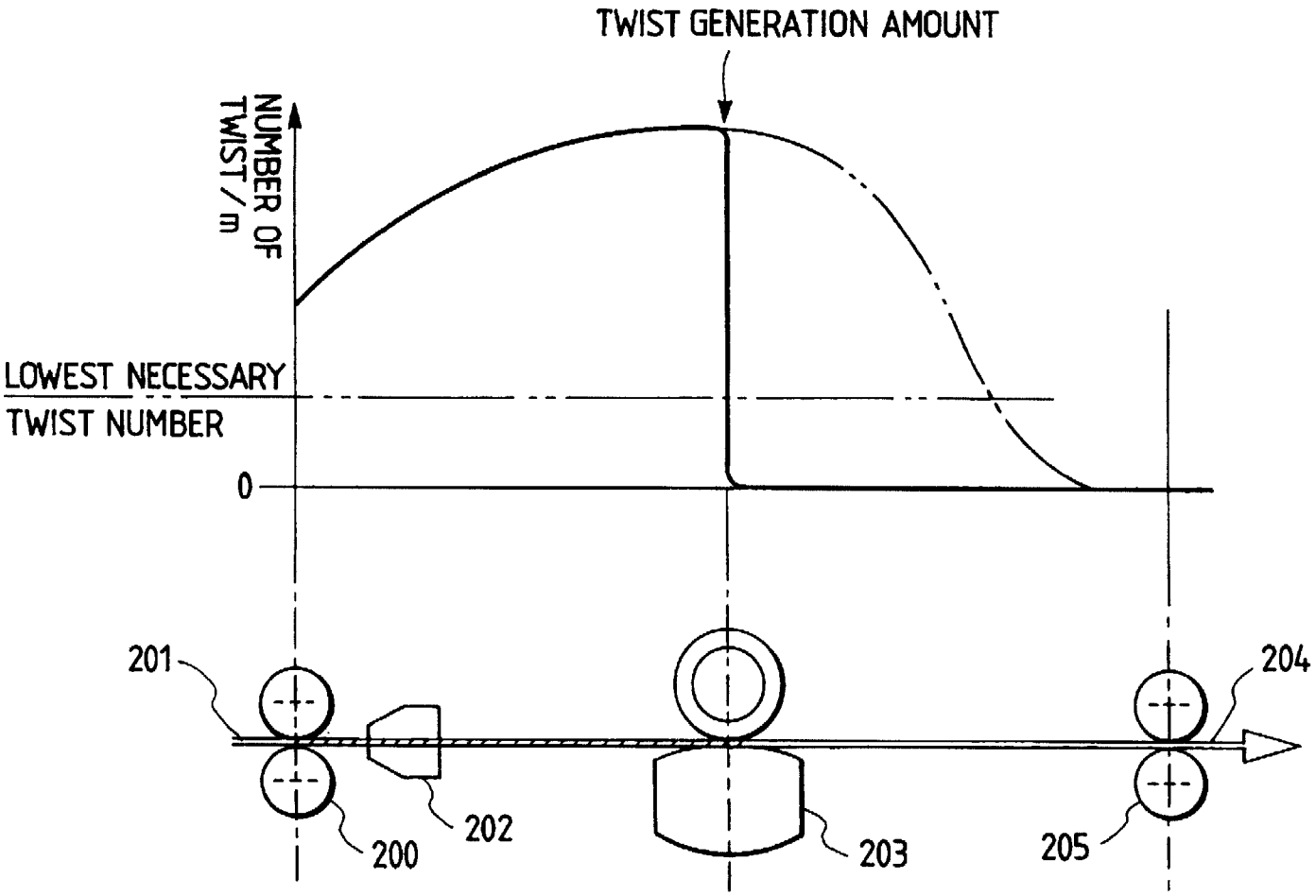
FIG. 5 is a diagram showing twist number of a yarn and the main structure of the spinning apparatus of this invention.

FIG. 5 shows an outline of the main part of the spinning apparatus of this invention. Now, the spinning principle will be explained. The sliver 201 which is an aggregate of the staple fibers having passed the front roller 200 of the draft apparatus is converged by the rotating air current of the air spinning nozzle 202 and a false twist imparted by the nip type false twist apparatus 203. This false twist reaches to the front roller 200. The majority of the fibers that leave the front roller 200 are twisted by the aforementioned false twist but a portion of the fibers are not twisted. These remaining fibers are wound in the opposite direction on to the false twisted fibers as core fibers by the rotating air current (rotating in the opposite direction to the false twist direction of the false twist apparatus 203) of the air spinning nozzle 202 and become winding fibers. In this state, when the fiber aggregate passes the false twist apparatus 203, the core fibers are untwisted and as well as the core fibers becoming roughly parallel, the winding fibers become tightly fastened parallel core fibers and form a fastened spun yarn 204. After that, the fastened spun yarn 204 is transported by the delivery roller 205 being a feed roller.

The most characteristic point of this invention is that the fiber aggregate is completely nipped and a false twist imparted by the false twist apparatus. In order to completely nip the fiber aggregate, the speed of the component of the fiber aggregate transport direction of the running member of the false twist apparatus 203 and the running speed of the fiber aggregate in the nip range of the false twist apparatus 203 must essentially agree. Due to the complete nip, the twist imparted in the fiber aggregate disappears rapidly after passing the nip point of the false twist apparatus 203 as in the graph showing twist numbers in FIG. 5. This means that the aforementioned false twist disappears within the contact range of the yarn and the running member of the false twist apparatus 203. In this way, as the twist imparted in the fiber aggregate is suddenly removed within the contact range of the yarn and the running member of the false twist apparatus 203, a round sectioned yarn is formed-and hairiness on the surface of the yarn is drastically reduced. In order to realize this, the running member of the false twist apparatus 203 should be formed so as to have a convex curve at least at the nip area and the nip strength should be made strong in the central part of the nip area and weaker toward the entrance and exit of the fiber aggregate of the nip area.

Also, the fiber aggregate tension between the front roller 200 and the false twist apparatus 203 is an important element for the spinning method of this invention. To convey the twist generated by the false twist apparatus 203 to the front roller 200 position, a predetermined tension must be applied to the fiber aggregate between the front roller 200 and the false twist apparatus 203. In order to do this, it is necessary for the circumferential speed of the front roller 200 and the speed of the transport direction component of the fiber aggregate of the running member of the false twist apparatus 203 is be roughly equal or for running member speed to be slightly higher than the rotating speed of the front roller 200. The next important element is the relationship between the speed of the transport direction component of the running member of the false twist apparatus 203 and the circumferential speed of the delivery roller 205. Both speeds must be adjusted to a speed that does not break the yarn 204 due to the tension. Consequently, on this spinning apparatus, if spinning is to be done at a predetermined spinning speed, first the speed of the front roller 200 should be decided, then the speed of the false twist apparatus 203 and finally the speed of the delivery roller 205.

This invention is composed as in the aforementioned explanation thus demonstrating the following effectiveness.

As a contact surface is formed that nips the fiber bundle by contacting the hollow cylindrical rollers having elastic properties, the fiber bundle can be reliably nipped in conjunction with the elasticity and the centrifugal force of the hollow cylindrical roller. Therefore, even when driving the false twist apparatus at high speed a sufficient false twist can be imparted and a strong delivery force and unwinding force can be applied to the fiber bundle. Consequently, not only can high speed spinning be achieved, but also a strong, uniform spun yarn with little hairiness can be manufactured.

As the member that nips the fiber bundle consists of a hollow cylindrical roller there is little rotational vibration or little deformation and high speed rotation of the roller is possible. Therefore as well as high speed spinning being possible a stronger nipping force is generated by the centrifugal force of the hollow cylindrical roller and as a consequence, sufficient false twist can be imparted and a strong delivery force and unwinding force can be applied to the fiber bundle.

As the hollow cylindrical roller is formed of elastic material, moreover, as the central part of the roller is expanded to form a barrel shape, by changing the roller position, the contact surface area and contact force can be easily controlled.

As there are holes bored in the hollow cylindrical roller, deformation or shrinkage of the hollow roller due to the temperature differences between the outside and inside of the hollow cylindrical roller are prevented.

Also, as on the spinning apparatus that is formed from a pair of rotating bodies which intersect each other and are maintained in a contact position and nip the yarn by the contact part, the pair of rotating bodies are formed from flexible and elastic material, and as they differ in their stiffness, heat generation between the rotating bodies is suppressed, the contact surface area is enlarged and the nip point is maintained as a large area. Due to this, stable false twisting can occur, moreover, deviation of the yarn from the nip point and yarn breakage due to this is reduced and when yarn joining, the introduction of the yarn between the rotating bodies is easy. Furthermore, operating the control and setting of the pressing amount of the rotating bodies is easy and the durability of the rotating bodies is increased.

Also, due to the aforementioned pair of rotating bodies being hollow rollers and to there being differences in the thickness of the roller circumference wall between each of them, the hollow rollers differ in stiffness, the above effectiveness is increased, thus selection of the hollow roller material and selection and alteration of the stiffness ratio is easy.

In addition, as in a spinning apparatus, an air spinning nozzle which generates a rotating air current is positioned upstream in the yarn path of the aforementioned rotating bodies, yarn qualities such as yarn strength and uniformity are outstanding. Moreover, as well as a little hairiness and outwardly superior yarn being able to be spun, high speed spinning is possible, yarn breakage is prevented, stable spinning can be carried out and the overall productivity of the yarn can be improved.

What is claimed is:

1. A spinning apparatus of a draft device for drafting fiber aggregate, comprising:

a front roller of a draft device for drafting fiber aggregate;

a spinning nozzle for generating air current rotating in a direction reverse to a false twisting direction by a pair of false twisting units and having an upstream side disposed immediately adjacent to said front roller and aligned for receiving a fiber aggregate from said front roller and a downstream side for discharging said fiber aggregate and disposed downstream and immediately adjacent to said front roller;

said pair of false twist units having a central portion, each of said false twist units including a hollow roller of flexible elastic material and disposed on said downstream side of said spinning nozzle, said central portion of said hollow roller being expanded and forms a barrel shape.

2. The spinning apparatus as recited in claim 1, wherein said flexible elastic material of said hollow roller includes a hole extending through said material and venting a hollow interior of said roller to the atmosphere for cooling said hollow roller.

* * * * *